US007665931B2

(12) United States Patent
Deringer

(10) Patent No.: US 7,665,931 B2
(45) Date of Patent: Feb. 23, 2010

(54) PIER CONSTRUCTION SUPPORT SYSTEM

(76) Inventor: Jerald A. Deringer, 770 Franklin St., Baldwin, WI (US) 54002-9312

( * ) Notice: Subject to any disclaimer, the term of this patent is extended or adjusted under 35 U.S.C. 154(b) by 445 days.

(21) Appl. No.: 11/382,621

(22) Filed: May 10, 2006

(65) Prior Publication Data

US 2006/0269363 A1 Nov. 30, 2006

Related U.S. Application Data

(60) Provisional application No. 60/679,366, filed on May 10, 2005.

(51) Int. Cl.
*E02D 27/50* (2006.01)

(52) U.S. Cl. ..... 405/231; 405/244; 248/636

(58) Field of Classification Search ..... 405/231–244; 248/636; 52/167.1–167.9
See application file for complete search history.

(56) References Cited

U.S. PATENT DOCUMENTS 1,651,411 A * 12/1927 Porter ..... 52/167.6
4,266,888 A * 5/1981 Bayer et al. ..... 405/202
4,320,549 A * 3/1982 Greb ..... 14/73.5
4,496,130 A * 1/1985 Toyama ..... 248/585
5,442,883 A * 8/1995 Nishimura et al. ..... 52/167.2
5,867,951 A * 2/1999 Yaguchi et al. ..... 52/167.4
6,085,471 A * 7/2000 Axon ..... 52/167.4
6,126,136 A * 10/2000 Yen et al. ..... 248/560
6,324,795 B1 * 12/2001 Stiles et al. ..... 52/167.4
6,554,542 B2 * 4/2003 Mano et al. ..... 405/251
6,688,051 B2 * 2/2004 Tsai ..... 52/167.4
7,267,319 B2 * 9/2007 Vitrone ..... 248/649
2005/0241245 A1 * 11/2005 Tsai ..... 52/167.1

* cited by examiner

*Primary Examiner*—Tara Mayo-Pinnock
(74) *Attorney, Agent, or Firm*—Nawrocki, Rooney & Sivertson, P.A.

(57) ABSTRACT

A pier support system provides an arrangement for constructing a pier either onsite or offsite. Support apparatus provides four sides arranged in a square which are supported vertically from a planar pier support base. The walls are inset from the edge of the pier support base to provide a margin around the sides of the base to permit constructing an outer wall using blocks and cement adjacent to each support side. Two methods of attaching a footing base to a site are shown. The pier support base is attached to the upper side of an installed footing base by a two axis and verticality adjusting apparatus. The outer wall is constructed after the bases are connected and then the pier verticality is adjusted and a cap installed to complete the pier.

2 Claims, 6 Drawing Sheets

PIER CONSTRUCTION SUPPORT SYSTEM

CROSS-REFERENCE TO RELATED APPLICATIONS

This is a regular application filed under 35 U.S.C. § 111(a) claiming priority, under 35 U.S.C. § 119(e) (1), of provisional application Ser. No. 60/679,366 previously filed May 10, 2005 under 35 U.S.C. § 111(b).

BACKGROUND OF THE INVENTION

1. Field of the Invention

This invention teaches the construction of a pier, of the type currently constructed onsite, at either an onsite or an offsite location. The invention includes provisions for rapid installation and later vertical alignment of the pier at a site. A supporting structure for later constructed walls, which form the sides of the pier, provide for rapid and simple pier construction.

2. Description of the Related Art

Currently a pier is completely constructed onsite. This is labor intensive since a support structure must be built on site for each pier constructed. Precise vertical orientation of a pier is also currently difficult to achieve and maintain.

The offsite construction of a complete pier with only installation and alignment onsite, or offsite construction of a pier support frame to provide support for the pier sidewall construction has many benefits. This not only provides a superior product but saves on expensive onsite labor. This approach can combine artistic architecture with fast installation along with better quality, and better design. Either onsite or offsite manufacture of a pier using a support structure can readily provide more sophisticated and more accurate construction than those currently available.

SUMMARY OF THE INVENTION

This invention provides offsite factory manufacture of either a complete pier with later installation at a site, or offsite construction of a pier support frame with onsite installation of the frame and then construction of walls around the support frame. Alignment apparatus is provided which permits adjusting the vertical orientation and location of the pier onsite after installation. The pier can be constructed on a frame onsite because the sides and the top of the pier are planar which permits using mortar and blocks to construct vertical pier side walls using conventional brick or block laying techniques. Using these construction techniques stones, bricks, cement blocks, wooden blocks, or even decorations or a wooden panel can be secured to the walls by appropriate means.

A planar footing base of approximately the same size and shape as the pier support base is used to attach the pier to the site. The footing base has cylindrical extensions attached to one side of the footing base extending outward. A hole, which is reinforced by a cylindrical shaped form, is filled with fresh cement and the footing base is placed over the top of the form with the rebars extending downward into the fresh cement. When the cement has cured into concrete the footing base will be firmly attached to the site. As an alternative, a piling with an cylindrical shaped upward opening can be mated with a cylindrical shaped piling receptacle attached to the footing base to attach the pier to the site.

The opposite side of the footing base has a cylindrical extension attached to the center of the base by welding. The pier support base and footing base are connected together by angular adjustment apparatus attached to the upwardly extending footing projection. This adjustment apparatus is arranged to permit adjusting the angle between the bases along two axis which are at right angles to each other in the plane of the pier support base and essentially at right angles to the footing projection. This same apparatus can also adjust the vertical location of the pier. This apparatus is arranged to permit attaching the pier to the site with the cylindrical projection, and then adjusting the vertical orientation of the pier using the adjustment apparatus. With this arrangement, the pier can be aligned any time later or can be removed by simply detaching the angle adjusting apparatus from the footing projection.

BRIEF DESCRIPTION OF THE DRAWINGS

The objects and features of the present invention will become more manifest to those skilled in the art upon a reading of the following descriptions, taken in connection with the accompanying drawings and wherein.

DETAILED DESCRIPTION OF THE INVENTION

Figure 1:
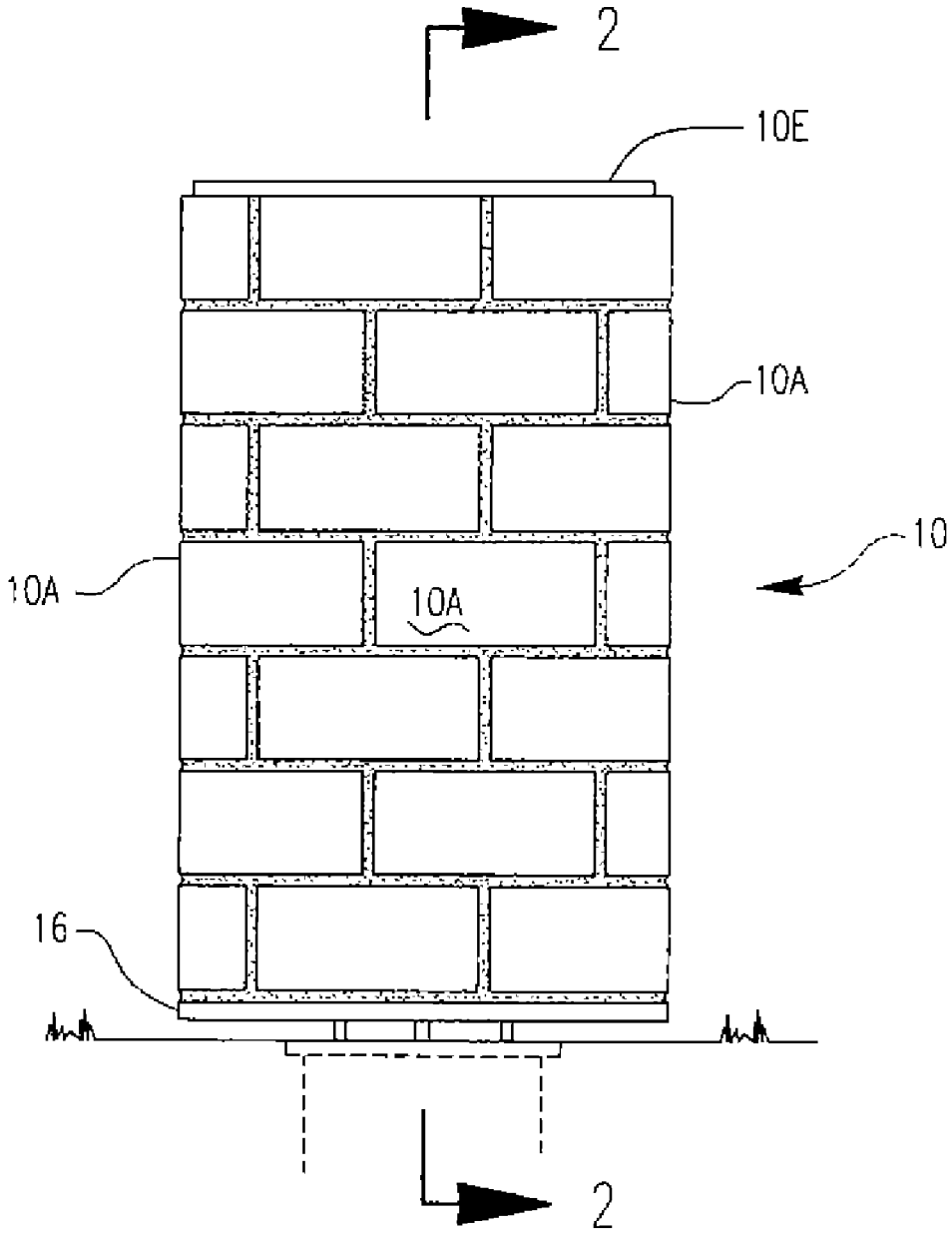
FIG. 1 is an isometric view of the support structure proper.
Figure 2:
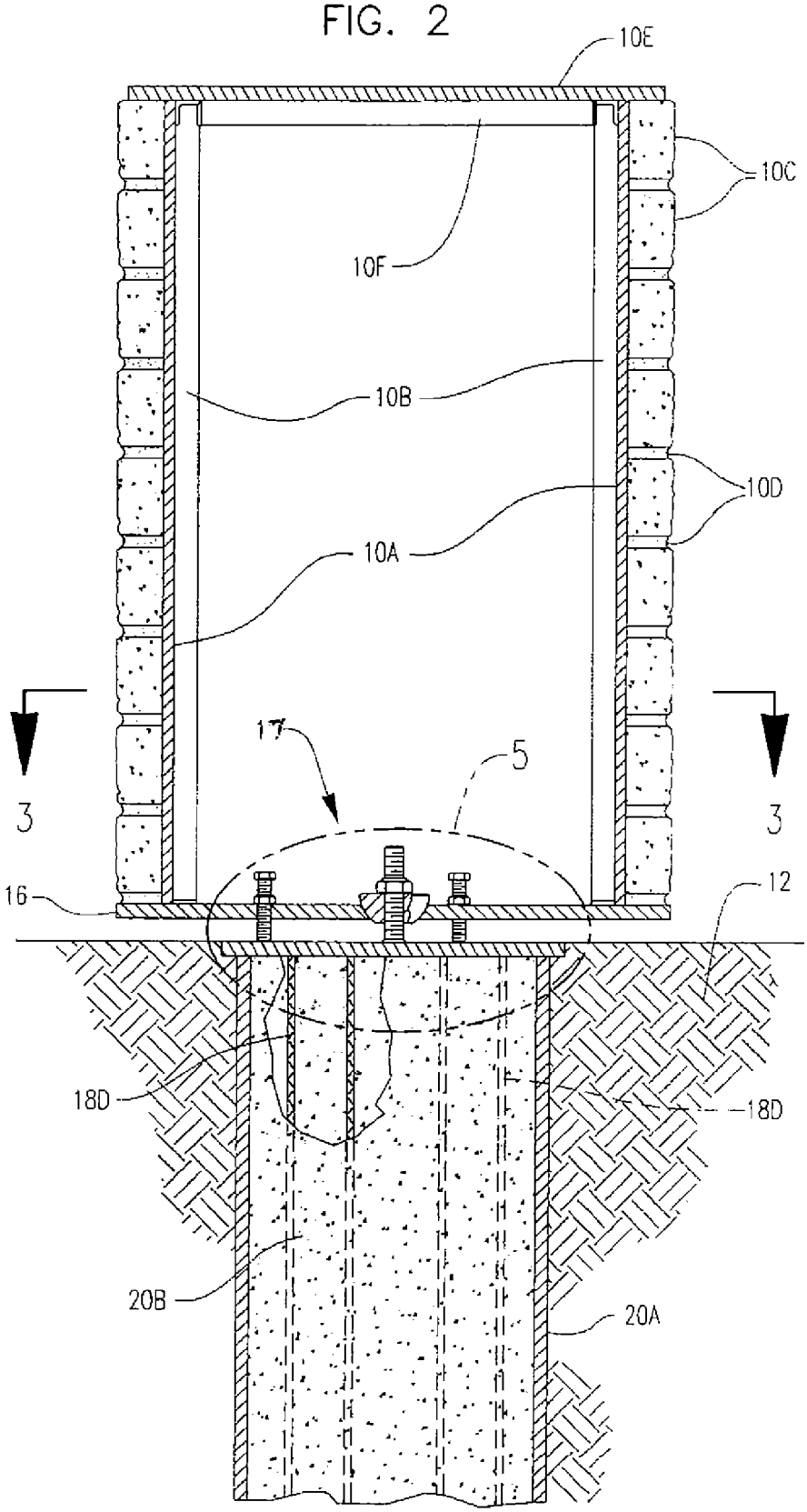
FIG. 2 is an isometric view of the pier support base with vertically extending vertical supports and rebars and the angular adjusting apparatus.
Figure 3:
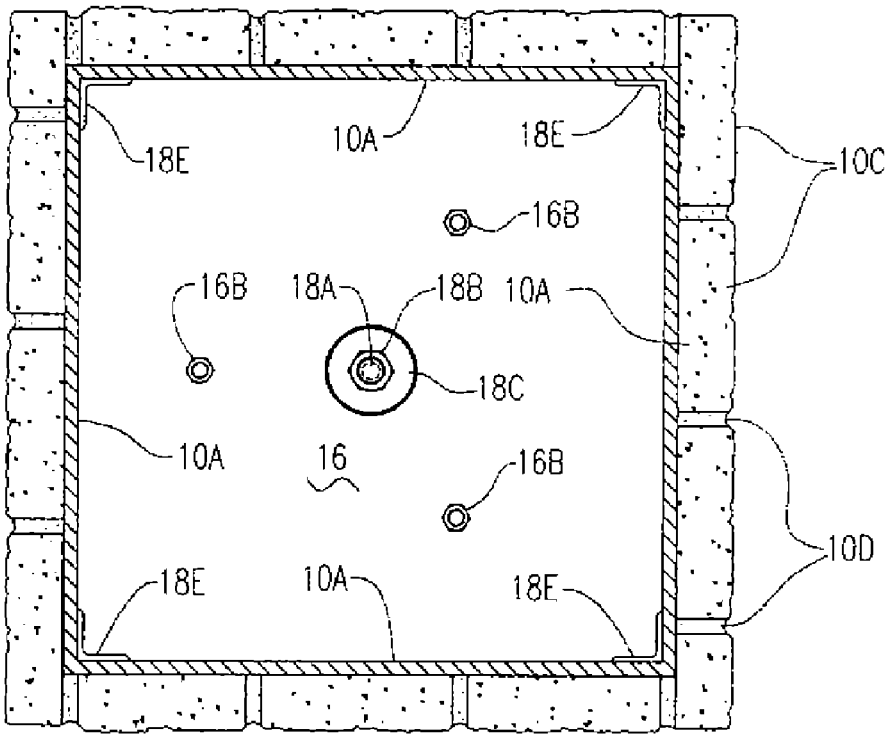
FIG. 3 is an isometric view of the pier support base with vertically extending vertical supports and rebars and only the holes for the angular adjusting apparatus.
Figure 4:
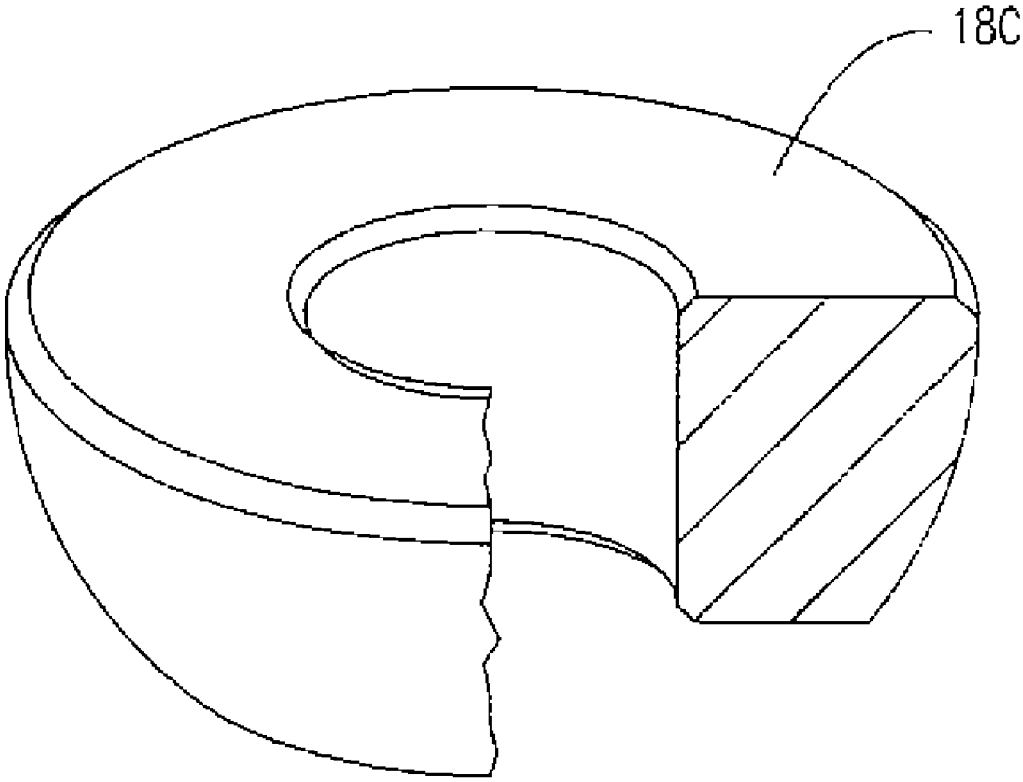
FIG. 4 is an isometric view of the pier support using a planar side support showing how construction material is supported by the support structure side and the extending pier support base.
Figure 5:
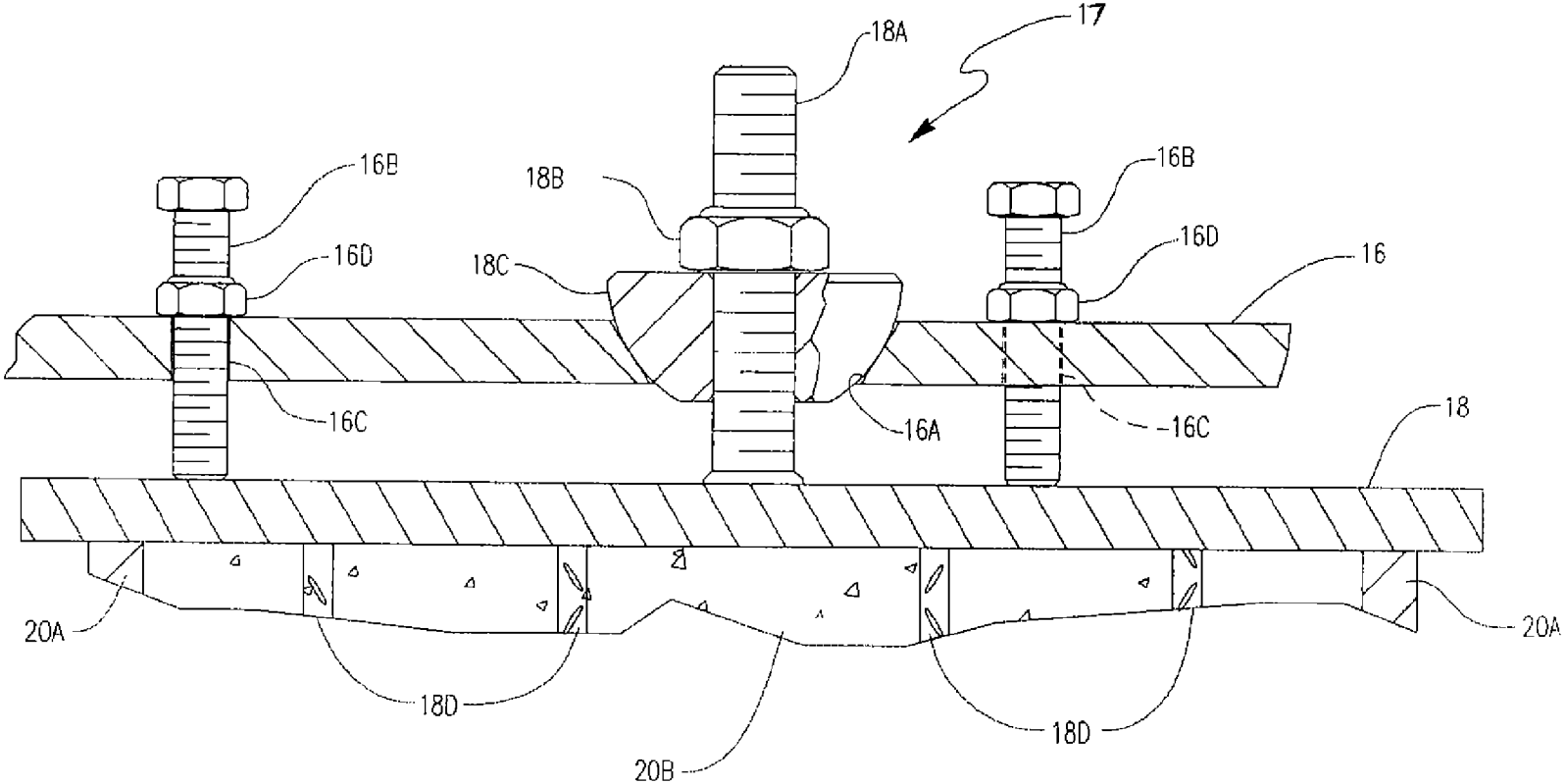
FIG. 5 is an isometric view of a corner of the upper corner of the pier support.
Figure 6:
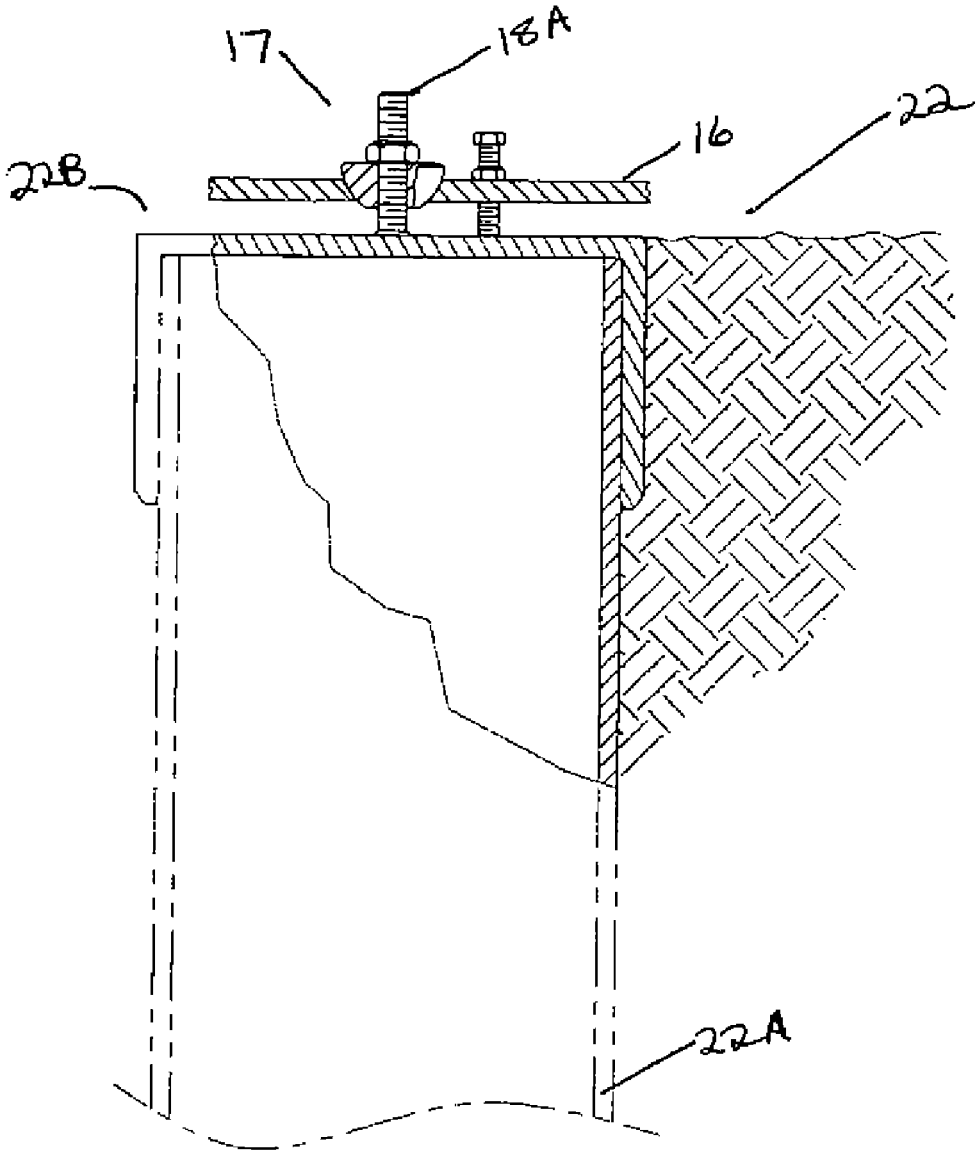
FIG. 6 is an isometric view of the pier support base with the angular adjusting apparatus and site connection apparatus.

A pier 10 is shown installed at a site in FIGS. 1 and 2. Details of pier 10 and angular adjustment apparatus 17 are shown in FIGS. 3, 4, and 5.

Pier support base 16 provides a base for pier 10. Pier support base 16 extends outward past sides 10A and is rectangular in shape to provide support for the four sides.

A two axis angle adjustment apparatus 17 permits changing the angular relationship between pier support base 16 and footing base 18 about two perpendicular axes. Freedom of motion between pier support base 16 and footing base 18 is provided by a partial semi-hemisphere 18C. Partial semi-hemisphere 18C has a centered hole 18D sized to admit footing projection 18A with the planar surface of the hemisphere opposite a parallel smaller planar surface created by removing a portion of the hemisphere. Pier support base 16 has a centered hole 16A sized and shaped to slidably engage the surfaces of partial semi-hemisphere 18C adjacent to the pier support base. Footing base 18 has a threaded cylindrical footing projection 18A welded perpendicularly to the center on the side of the footing base facing pier support base 16. Footing projection 18A extends from footing base 18 through hole 18D in partial semi-hemisphere 18C and is secured by nut 18B. With this arrangement pier support base 16 can be moved with respect to footing base 18 to change the angular relationship between the bases around two perpendicular axes.

The angular relationship between pier support base 16 and footing base 18 is adjusted by three bolts 16B which extend through mating threaded holes 16C in pier support base 16.

Holes 16C are located essentially 120 degrees apart and are equidistant from the center of base 16. For heavy piers more than three bolts 16B can be provided also centered on a circle equidistant from the center of base 16. Nuts 16D are welded to footing base 18 opposite holes 16C and provide additional strength for securing bolts 16D to pier support base 16. Two axis angle adjustment between pier support base 16 and footing base 18 is obtained by rotating threaded nuts 16D. If all nuts 16D are rotated the same amount in the same direction, regardless of the number of footing projections 18A and mating nuts 16D used, pier support base 16 will be moved vertically with respect to footing base 18 which provides an additional vertical adjustment option.

Pier 10 is secured to a site using rebars 18E which are welded to footing base 18 on the side of the footing base opposite bolt 18D and extend outward perpendicularly. In one method of securing pier 10 to the site, hole 20 is first prepared. Hole 20 is reinforced by a cylindrical shaped reinforcement 20A. Freshly mixed cement 20B is then used to fill reinforcement 20A. Rebars 18E of pier 10 are then inserted into hole 20 until footing base 18 is positioned against reinforcement 20A. Footing base 18 will be firmly attached to the site after cement 20B has set.

An alternate method of securing the footing base 18 to a site utilizes a piling 22A driven into the ground which has a cylindrical shaped top. A mating cylindrical shaped receptacle 22B with footing projection 18A centered on the top of the receptacle receives the piling top which attaches the apparatus to the site.

Pier 10 is constructed onsite around a supporting framework of support sides 10A and a pier support base 16. Four corner supports 16E, which have a right angle cross-section, are attached at one end to each corner of the pier support base 16 extending outward perpendicularly. The corner supports 16E are attached with their sides parallel to the edges of pier support base 16. Four support sides 10A are attached along their length to the parallel outer surfaces of adjacent corner supports 16F to secure them in place. Corner supports 16E are attached to pier support base 16 offset from its edge which provides a margin along sides 10A along all sides support for later constructed walls adjacent to each support side.

Four outer walls 10G, one adjacent to each side 10A, are then constructed by attaching stones 10C above the margins of pier support base 16 and against the support sides 10A using cement 10D. This construction proceeds from pier support base 16 upward to the top of sides 10A. After cement 10D has hardened into concrete the outer walls 10G of pier 10 are complete. Alternative construction methods, described earlier, can also be used. The essence of this construction method is that a wall is assembled on all four sides positioned over the margins around pier support base 16.

Cap 10E can be assembled either onsite or offsite. Cap 10E is planar, rectangular in shape, and sized to cover the top of pier 10. Cap 10E has a backing plate 10F and can either be separate or can be molded as part of the cap. In either case backing plate 10F is sized to fit within sides 10A of pier 10. Placing cap 10E over sides 10A pier 10 completes construction of pier 10.

When pier 10 is manufactured offsite, the constructed wall 10G is constructed offsite over the pier support base 16 and four support sides 10A attached to each other as described above. The remaining operations are completed onsite. First footing base 18 is attached to a site as described above. The pier support base 16 is then attached to footing base 18 by the angle adjustment apparatus 17, as before. The verticality of pier 10 is then adjusted and cap 10F placed over the top of the pier to complete pier 10, as before.

Variations and alternatives to this invention includes an alternative method of constructing a pier offsite. This method uses rebars attached perpendicularly to pier support base 16 to provide support for constructed walls 10G. Sides 10A can be made of either treated wood or of metal. The important characteristic here is that sides 10A be planar to support a planar constructed wall 10G. Hole reinforcement 20A can be tile, cardboard or any material that need only temporarily support freshly mixed cement, since after the cement has hardened no reinforcement is necessary. When a piling is used the receptacle can be on the site or on the footing base with no difference in performance. While stones 10C were used here for the constructed walls 10G, a variety of other materials could be used. These materials can include such material as: bricks, stone blocks, decorative panels and wooden blocks attached to the sides by appropriate means. Walls 10G could even be a wooden panel if desired.

An important advantage of connecting a pier to a site using the above described method, after removing the pier proper, is that the pier can be disconnected by simply cutting through footing projection 18A leaving a planar surface. Since the pier can be adjusted vertically the footing base can be located below the level of adjacent ground with the bottom of the pier at ground level. With this arrangement when the pier is removed the recess can be landscaped with all evidence of a prior pier site removed. The pier can then be relocated to a different site using the above techniques.

It will be understood that this disclosure, in many respects, is only illustrative. Changes may be made in details, particularly in matters of shape, size, material, and arrangement of parts without exceeding the scope of the invention. Accordingly, the scope of the invention is as defined in the language of the appended claims.

What is claimed is:

1. Adjustment apparatus comprising:

a) similar sized first and second planar plates, said first plate providing a pier support base and said second plate providing a footing base, the plates being positioned opposite each other with their edges essentially aligned, each plate having a planar first and second side with the second side of the first plate facing the first side of the second plate;

b) two axis inclination adjustment means for adjusting the angles between the first and second plates; and c) spacing adjusting means for adjusting the spacing between the plates;

wherein said two axis inclination adjustment means comprises the first plate having at least three threaded holes equally spaced on a circle extending around its center with an equal number of mating bolts and mating lock nuts, the bolts being threaded through the lock nuts then into the holes from the first side of the first plate extending inward toward the first side of the second plate, after adjusting the extension of the bolts to various lengths to obtain the desired parallel relationship between the plates, the bolts are secured using the lock nuts, with the bolts all being adjusted the same amount in the same direction to accommodate spacing changes.

2. Apparatus as in claim 1 wherein said spacing adjusting means comprises:

a) a partial hemisphere having the usual circular shaped planar surface of a hemisphere located on the opposite side from a smaller circular shaped essentially parallel second surface;

b) said first plate having a centered hole of the size and shape to slideably mate with the exterior surface of said partial hemisphere between the two circular surfaces with the partial hemisphere located within said centered hole with the larger circular surface on the same side as the first side of the first plate;

c) a threaded footing projection attached to the center of the first side of said second plate extending outwardly perpendicularly therefrom, the partial hemisphere having a clearance hole between the centers of the two circular shaped surfaces which slideably mates with the treaded footing projection, the centered hole through the partial hemisphere being positioned over said footing projection with the partial hemisphere within the slideably mating hole in the first side of said first plate with the larger circular portion of the partial hemisphere located on the same side as the first side of the first plate, the apparatus further having a nut which mates with said threaded footing projection threaded on the outer end of said footing projection, the spacing adjustment between the plates being providing by rotating said mating nut to change the plate spacing to the desired amount.

* * * * *